US009643053B2

(12) United States Patent
Guiney

(10) Patent No.: US 9,643,053 B2
(45) Date of Patent: May 9, 2017

(54) CLIMBING AID

(76) Inventor: Stephen Raymond Guiney, Wellington (NZ)

( * ) Notice: Subject to any disclaimer, the term of this patent is extended or adjusted under 35 U.S.C. 154(b) by 980 days.

(21) Appl. No.: 13/138,110

(22) PCT Filed: Dec. 17, 2009

(86) PCT No.: PCT/NZ2009/000291

§ 371 (c)(1),
(2), (4) Date: Sep. 27, 2011

(87) PCT Pub. No.: WO2010/082843

PCT Pub. Date: Jul. 22, 2010

(65) Prior Publication Data

US 2012/0011632 A1 Jan. 19, 2012

(30) Foreign Application Priority Data

Jan. 7, 2009 (NZ) ..... 574089

(51) Int. Cl.
*A63B 27/00* (2006.01)
*A63B 71/12* (2006.01)

(52) U.S. Cl.
CPC ..... *A63B 27/00* (2013.01); *A63B 71/12* (2013.01); *A63B 71/1225* (2013.01); *A63B 2071/125* (2013.01); *A63B 2071/1258* (2013.01)

(58) Field of Classification Search
CPC ... A63B 27/00; A63B 71/12; A63B 2071/125; A63B 71/1225; A63B 2071/1258
USPC ..... 2/16, 455, 22–24, 62, 911, 45; 602/16, 602/20, 23, 26; 182/221, 134
See application file for complete search history.

(56) References Cited

U.S. PATENT DOCUMENTS

| | | | | | |
|---|---|---|---|---|---|
| 1,624,129 | A | * | 4/1927 | Barrett | 2/22 |
| 2,484,181 | A | | 10/1949 | Munger et al. | |
| 2,982,968 | A | * | 5/1961 | Groot | 2/22 |
| 3,981,526 | A | | 9/1976 | Lundqvist | |
| 4,344,189 | A | | 8/1982 | Futere et al. | |
| 4,580,296 | A | | 4/1986 | Cano | |
| 4,674,157 | A | * | 6/1987 | Litz | 24/442 |
| 4,692,946 | A | * | 9/1987 | Jurga | 2/22 |
| 4,751,748 | A | * | 6/1988 | Ekins | 2/22 |
| 4,833,729 | A | | 5/1989 | Fox et al. | |
| 4,888,826 | A | * | 12/1989 | Parsons et al. | 2/22 |
| D361,869 | S | * | 8/1995 | Paffett et al. | D29/120.1 |
| 5,452,475 | A | * | 9/1995 | Hunt, Jr. | 2/22 |

(Continued)

FOREIGN PATENT DOCUMENTS

WO WO 01/87432 A2 11/2001

OTHER PUBLICATIONS

Written Opinion of the International Searching Authority for PCT/NZ2009/000291, mailed May 28, 2010.

(Continued)

*Primary Examiner* — Khaled Annis
(74) *Attorney, Agent, or Firm* — Nixon & Vanderhye P.C.

(57) ABSTRACT

Protective equipment for the limbs including a front guard, wherein the front guard includes support means attached to the front guard, a front surface, and a plurality of teeth protruding from the front surface for assisting a user in climbing over an obstacle, wherein the teeth include at least one engagement surface arranged to at least partially engage with a surface of the obstacle when pressure is applied to the support means.

44 Claims, 4 Drawing Sheets

(56) References Cited

U.S. PATENT DOCUMENTS

| | | | | |
|---|---|---|---|---|
| 5,537,689 | A * | 7/1996 | Dancyger | 2/24 |
| 5,611,080 | A * | 3/1997 | Skottheim | 2/16 |
| 5,611,081 | A | 3/1997 | Torres | |
| 5,652,956 | A * | 8/1997 | Hoshizaki et al. | 2/22 |
| 5,806,092 | A * | 9/1998 | Shikatani | 2/22 |
| 5,829,055 | A * | 11/1998 | Collins et al. | 2/22 |
| 6,158,051 | A * | 12/2000 | Belzidsky | 2/22 |
| 6,223,350 | B1 * | 5/2001 | McFarlane | 2/24 |
| 6,317,888 | B1 * | 11/2001 | McFarlane | 2/24 |
| D461,936 | S * | 8/2002 | Fiorini et al. | D29/122 |
| 6,560,781 | B1 * | 5/2003 | Keene et al. | 2/22 |
| 7,204,819 | B2 * | 4/2007 | Berger | 602/26 |
| 2001/0054526 | A1 | 12/2001 | Haltom | |
| 2002/0162153 | A1 * | 11/2002 | Collins et al. | 2/22 |
| 2003/0019006 | A1 * | 1/2003 | Godshaw et al. | 2/24 |
| 2004/0083527 | A1 * | 5/2004 | Budda | 2/22 |
| 2007/0124843 | A1 * | 6/2007 | Bevier | 2/22 |
| 2007/0163025 | A1 | 7/2007 | Godshaw et al. | |
| 2007/0250977 | A1 * | 11/2007 | Brown et al. | 2/22 |
| 2008/0178360 | A1 * | 7/2008 | Nascimento et al. | 2/22 |

OTHER PUBLICATIONS

International Preliminary Report on Patentability for PCT/NZ2009/000291, dated Nov. 1, 2010.

* cited by examiner

CLIMBING AID

This application is the U.S. national phase of International Application No. PCT/NZ 2009/000291 filed 17 Dec. 2009 which designated the U.S. and claims priority to NZ Application No. 574089, filed 7 Jan. 2009, the entire contents of each of which are hereby incorporated by reference.

FIELD OF THE INVENTION

The present invention relates to a climbing aid. In particular, the present invention relates to a climbing aid for attachment to the limbs that assists a user in negotiating obstacles.

BACKGROUND

Protective equipment is commonly provided to personnel in various organizations such as the army, fire fighting services, police and Special Forces etc. The equipment currently provided is primarily aimed at protecting various parts of the user's body when the user is found to be in a situation that can cause injury to the user. For example, protective garments are provided to fire fighters to assist in mitigating the effects of heat on the user's body. Also, protective garments are provided to assist in avoiding injury, such as cuts, bruises etc, to various extremities of the body, such as the legs or arms for example.

Protecting the legs, and in particular the shins and the knees, is particularly important in situations where the user is required to move over or through obstacles, including climbing and scrambling over the obstacles. For example, fire fighting services may be required to quickly enter into or exit out of a building via a window in order to rescue a third party or themselves. Also, army and police personnel may be required to move quickly over, through or under various obstacles: in pursuit of someone, to avoid being harmed, or to take advantage of a situation. At these times, it is not at the forefront of the minds of these persons to carefully utilise professional climbing skills in order to successfully climb or avoid injury, but rather to move as quickly as possible to from 'A' to 'B'. Thus, injury can be caused by persons attempting to scramble over door jambs, window frames with broken glass still attached, walls or fences with intrusion prevention measures attached, etc. Intrusion prevention measures may include, for example, barbed wire, shards of glass etc, that are attached to the barrier (wall, fence etc) to assist in preventing intruders from climbing over the barriers. The present invention aims to overcome, or at least alleviate, some or all of the afore-mentioned problems, or to at least provide the public with a useful choice.

SUMMARY OF THE INVENTION

According to one aspect, the present invention provides a climbing aid for attachment to the limbs including a front guard, wherein the front guard includes a weight bearing support means attached to the front guard, a front surface, and a plurality of teeth protruding from the front surface for assisting a user in climbing over an obstacle, wherein the teeth include at least one engagement surface arranged to at least partially engage with a surface of the obstacle when pressure is applied to the support means.

BRIEF DESCRIPTION OF THE DRAWINGS

Embodiments of the present invention will now be described, by way of example only, with reference to the accompanying drawings, in which:

FIGS. 6A-6D show protective equipment in the form of a climbing aid from different perspectives according to a further embodiment of the present invention;

DETAILED DESCRIPTION OF THE INVENTION

Various embodiments of the present invention are now described that use common protective equipment as a basis for a climbing aid.

First Embodiment

Figure 1:
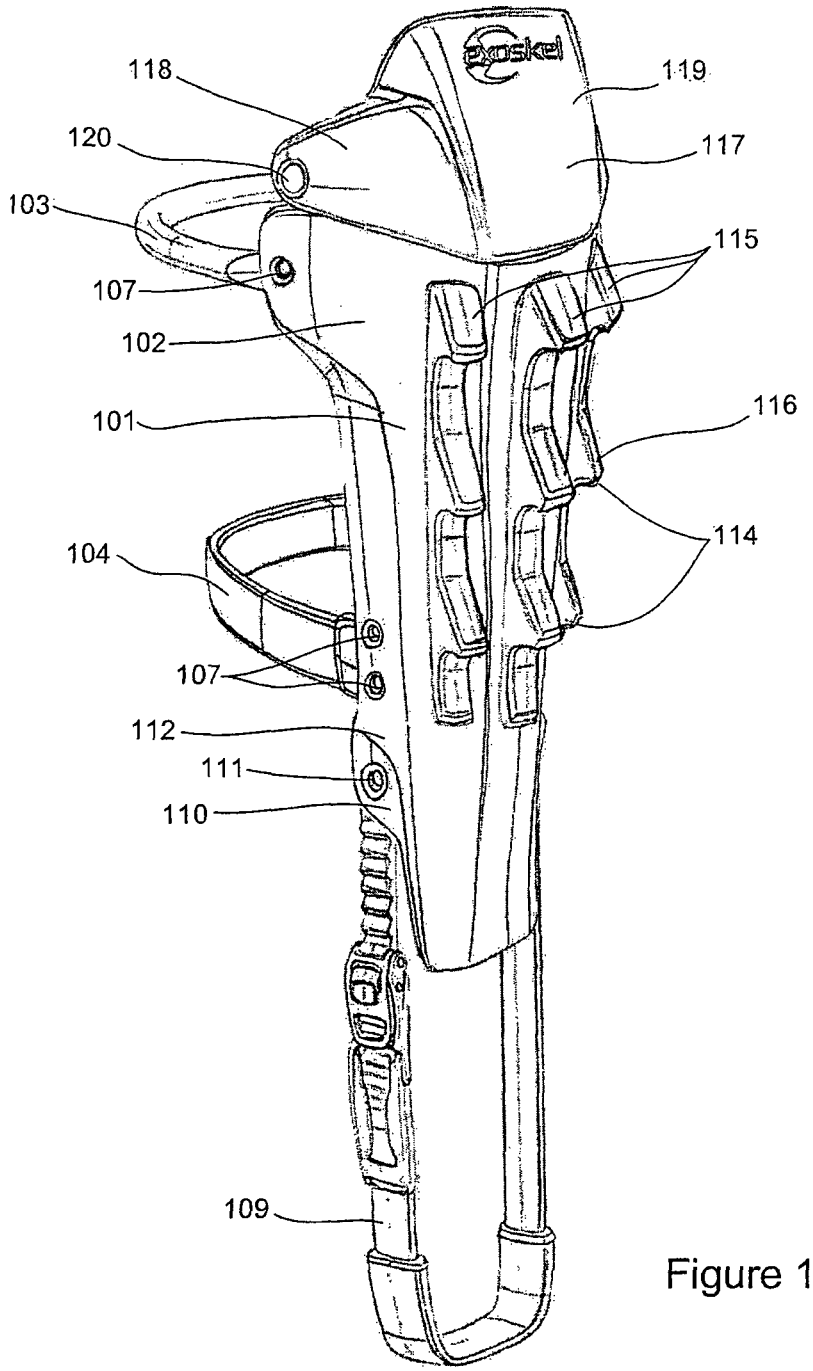
FIG. 1 shows protective equipment in the form of a climbing aid according to an embodiment of the present invention.

FIG. 1 shows a detailed view of protective equipment in the form of a climbing aid for protecting a user's limb, their leg in this particular example, when used in a hostile environment as described herein. The climbing aid aspect of the equipment serves to assist the user when climbing or scrambling over obstacles. For example, the user can use teeth on the equipment to engage a surface that the user wishes to climb or negotiate.

In particular, the climbing aid includes several components, which include a shin guard 101, a foot or support strap, a knee guard and a thigh guard. However, it will be understood that, as an alternative to the embodiment shown in FIG. 1, the climbing aid may include only the shin guard and foot strap, where the knee guard and thigh guard are optional add on portions for the equipment.

The shin guard 101 is moulded from any suitable hard wearing, rigid and strong plastics material. Preferable the material should be impervious to water to enable users to negotiate obstacles in a wet environment, whether actually submersed in water, such as the sea or lakes, or merely moving through wet terrain. As an alternative, the guard may be manufactured from any hard wearing and light metal, such as titanium, for example. The shin guard is also, when required in the circumstances, preferably fire proof, and resistant to UV damage.

The general shape of the guard in this embodiment is such that it will fit over a user's leg when worn. That is, the internal surface of the shin guard 101 is shaped to provide an internal cavity that will locate over, and generally fit around, a user's shin area of the leg. Formed on an upper portion of the shin guard 101, nearest to the user's knee when worn, are two extended portions 102 arranged to at least partially wrap around the upper part of the user's shin when in use. Attached to, and between the distal ends of each of the two extended portions 102 is an upper adjustable leg strap 103 arranged to locate around a user's leg at the top of the calf muscle and below the knee. In this embodiment 103 is a hollow rubber hose, which adds comfort for the user, particularly when in the kneeling position.

Connected to a mid portion of the shin guard 104 is a lower adjustable leg strap arranged to locate around a user's leg at the bottom of the calf muscle.

The leg straps in this embodiment are made from a durable and comfortable material. In appropriate circumstances, the material may also preferably be fire retardant. It will be understood that, as an alternative, the strap may be made from any other suitable material, such as, for example, a semi pliable plastics material, cloth material or elastic material. As the time a user may be expected to wear this equipment can change depending on its desired uses, the preferred material for the strap may be changed according to the use so that the user is not caused any discomfort.

The leg straps include an adjustment element that enables the strap to be lengthened and shortened between the two extended portions so the user is able to adjust how tightly the shin guard is affixed to their leg. In this embodiment, the adjustment is by way of a Velcro connection, which enables a user to easily adjust the fit of the guard.

Any suitable alternative adjustment element may be used, such as, for example, a belt buckle type arrangement with a number of holes and a locating pin which sets the length of the strap. Alternatively, another arrangement may be used whereby the end of the strap is placed though a figure 8 shaped loop for setting the length of the strap.

Each leg strap 103 & 104 is connected to the shin guard 101 by way of a number of connection elements 107. In this embodiment, the connection elements 107 are pins that locate through holes formed on the shin guard 101 and holes on the distal ends of the respective leg straps 103 & 104. The pins are locked into place by any suitable means. It will be understood that any alternative connection mechanism may be used to attach the distal ends of the leg straps to the respective portions of the shin guard.

The leg straps thus provide attachment means to attach the guard to the user's limb at an upper point and a central point. It will be understood that as an alternative, only one attachment means (e.g. leg strap) may be used to attach the guard to the limb.

A foot strap 109 is designed and made from a material that is durable, flexible and strong and, where appropriate, fire retardant. It is designed to be able to support or bear the weight of a user. In this particular embodiment, the U-shaped strap is made from a thin piece of plastics material that is attached at each distal end to a lower portion 110 of the shin guard 101. In addition this particular embodiment the foot strap or stirrup has a protective sheath over the weight bearing strap. It is envisaged that these protective sheaths will be easily fitted and disposable.

The foot strap may be made from any other suitable material, such as metal or a composite material.

The strap, or support element, in this embodiment forms a stirrup like arrangement. The lower portion 110 of the shin guard 101 is the portion that is nearest to the foot of the user when the guard is being worn. The foot strap 109 is affixed to the shin guard by way of a number of connection elements 111 in a similar manner to those described above in relation to the leg strap connection elements. These connection elements 111 are arranged to pass through apertures formed on the distal ends of the leg straps and into apertures (201 in FIG. 2) formed on the shin guard. Each distal end of the foot strap locates in a correspondingly shaped recessed portion (202 in FIG. 2) on the lower portion of the shin guard. Located around the front edge of the recessed portion on the shin guard is a raised portion 112 that is formed to provide a protective covering for the connection elements 111.

It will be understood that, as an alternative, the raised portions 112 may not be applied to the shin guard.

Affixed to a front surface of the shin guard are a number of teeth. The teeth are arranged to protrude out from the front surface. As an alternative to this embodiment, the teeth may be formed as an integral part of the shin guard in the moulding process. In this embodiment, the front surface is formed generally in an arc shape. However, it will be understood that alternative shapes may be used.

It will be understood that the teeth may be fixed to the front of the guard using any suitable means. For example, the teeth may be screwed onto the front surface of the guard, or stuck on using a suitably strong adhesive, to allow broken teeth to be replaced. Alternatively, the teeth may be moulded as an integral part of the front surface of the guard, In this embodiment, three columns 115 of teeth 116 are provided adjacent to each other, with three rows of teeth aligned vertically within each column. Each column is positioned substantially equidistant from each other. The teeth thus form a 3×3 matrix.

It will be understood that, as an alternative, any suitable arrangement of teeth may be used. For example, a single column, double column or three or more columns of teeth may be used. Also, the number of teeth in each column may be varied to include either a single tooth, or multiple teeth. The number of teeth and arrangement of the teeth will depend upon the expected activities of the end users.

The teeth are formed from a rigid material which in this embodiment is a polycarbonate plastic. As an alternative, the teeth may be formed from any other suitable material, such as metal or a composite material.

In this embodiment, the teeth 116 are shaped to form a downwardly formed slight hook arrangement. Each tooth includes at least one surface 114 (engagement surface) that is arranged to at least partially engage with the surface of an obstacle when a user is wearing the climbing aid and moving over or through the obstacle.

In this embodiment, the teeth are generally shaped liked a shark's tooth. That is, the teeth have an upper surface that protrudes in a direction generally downwards towards the lower portion of the shin guard and away from the front surface, and a lower surface that protrudes initially generally upwards towards the upper portion of the shin guard and then generally downwards towards the lower portion in an arc moving away from the front surface of the shin guard. The two ends of the upper and lower surfaces are formed so that they meet together at the engagement surface 114 thus forming a shark's tooth arrangement.

It will be understood that many different tooth designs may be utilised, other than the specific tooth design described in this embodiment, which would fall into the general scope of the present invention. For example, although the tooth described above has a single engagement surface that lies along a longitudinal edge of the tooth between the upper and lower surfaces of the tooth, as an alternative, the tooth edge may have one or more engagement surfaces, for example as a series (one or more) of spikes or protrusions, to form a spiked, jagged, toothed, serrated or notched edge. For example, there may be a single or double spike arrangement with each forming a point that protrudes from the edge of the teeth to form the engagement surface. As a further example, the whole of the tooth may be formed as a single or multiple spike arrangement.

The different types of teeth with different engagement surfaces may then be attached to the shin guard depending on who is using the equipment, the objects that are likely to be scaled and the environment in which the equipment is to be used. Alternative tooth designs and arrangements may be understood from other embodiments described herein and in particular as shown in FIGS. 3, 4, 5 and 6A-6D.

Each different type of tooth will therefore interact with the obstacle surface in a different manner depending on its form and configuration. For example, the engagement surfaces of the teeth may attach to or lock onto the surface of an obstacle when a user is wearing the climbing aid and moving over or through the obstacle. As a further example, the engagement surface of the teeth may cause the teeth to frictionally attach, grip or clamp onto the obstacle surface. The engagement surface may be arranged such that it locks onto the surface of the obstacle when the user is applying a downwards pressure, such as using their weight, and moving over or through the obstacle.

Figure 2:
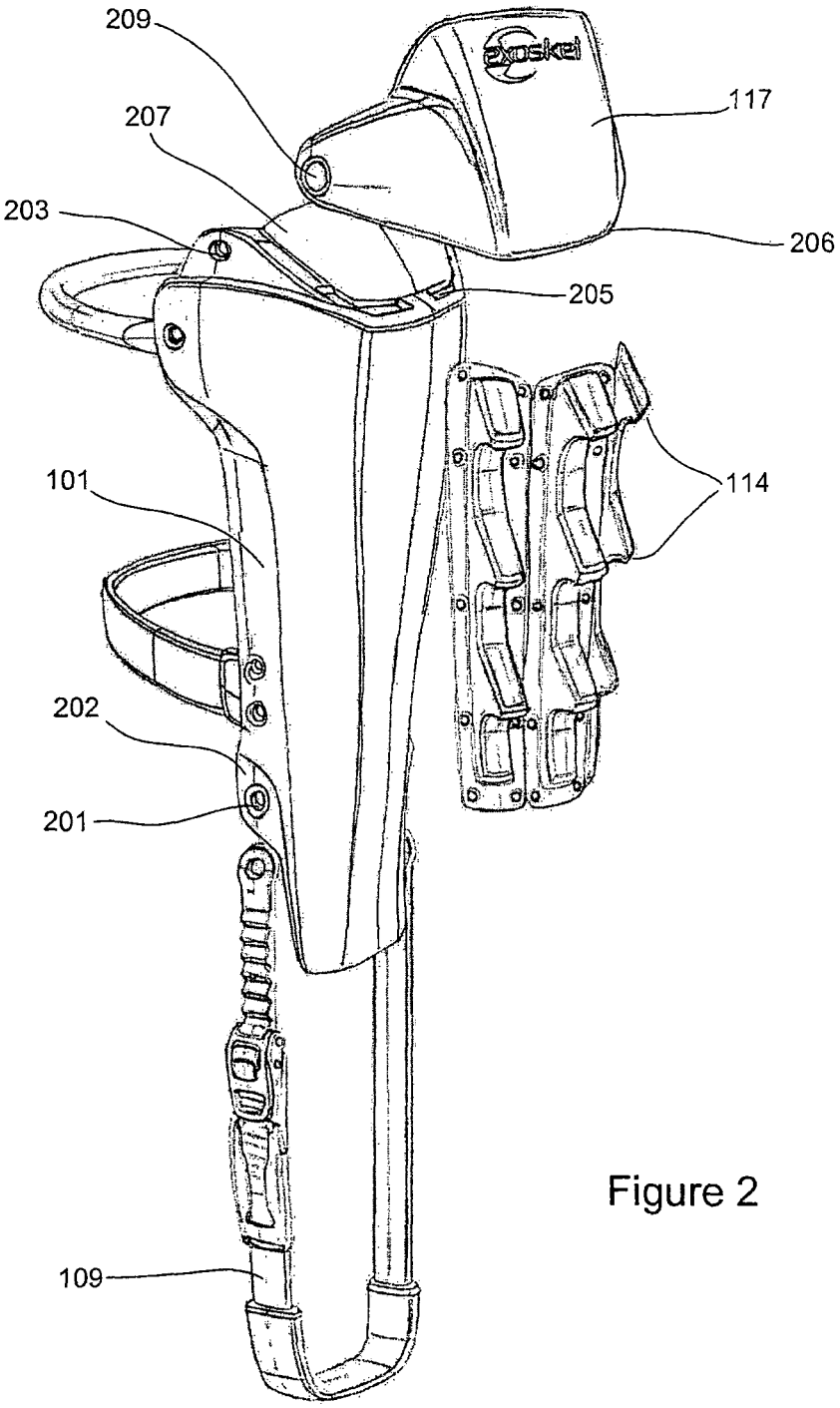
FIG. 2 shows an exploded view of a climbing aid according to an embodiment of the present invention.

Affixed to the inside concave surface of the shin guard is an internal padded lining 207, as shown in FIG. 2, which provides increased comfort to the user when wearing the equipment.

A knee guard 117 is provided in this embodiment. The knee guard is moulded from a plastics material. It will be understood that, as an alternative, other suitable materials may be used. The knee guard 117 is shaped to sit over, and at least partially wrap around, a user's knee. The substantially C-shaped knee guard includes two side portions 118 that extend from a concave front surface 119. Each of the two distal ends of the two side portions are arranged to align with an upper portion of the shin guard so that lower connecting element 120 can pivotally attach, for example in a hinge like manner, to a connecting element on the shin guard (see 203 in FIG. 2).

It will be understood that, as an alternative, the knee guard may be of a simpler more straight forward construction.

The knee guard 117 also includes an internal padded lining to protect the user's knee when the equipment is in use.

The connecting elements 120 enable the knee guard to pivotally move with respect to the shin guard and thigh guard (when used).

FIG. 2 shows an exploded view of the different components forming the climbing aid according to this embodiment. In this view the following components can be more easily seen, the apertures 201 for receiving the connection elements 111; the shaped recessed portion 202 for receiving the distal ends of the foot strap; the connecting element 203 on the shin guard for connecting to the knee guard; the internal padded lining 207 located on the inner surface of the shin guard; the connecting element 209 for connecting to the knee guard.

Also shown in FIG. 2 are recesses 205 located on an upper surface of the upper portion of the shin guard. The recesses 205 are located and shaped to receive corresponding protrusions 206 formed on the knee guard. These recesses 205 enable the corresponding protrusions 206 of the knee guard to stay in contact with the front surface of the upper portion of the shin guard as the knee guard is pivoted, thus providing a further barrier for any objects, and to stop objects from passing between the knee guard and the shin guard while the equipment is in use.

A user puts on the equipment by either placing their leg through the loops created by the leg straps. Alternatively, the leg straps may be undone fully and the user may apply the equipment against their lower leg by placing their foot in the foot strap and then re-connecting the straps.

Once the leg is passed through the loops, the foot is placed in the foot strap. The user is then able to tighten the straps to create a comfortable fit that enables the user to move around freely without being so tight as to cause discomfort or cut off blood circulation.

The user is then able to fully utilise the equipment for their desired purpose as follows.

For example, if the user is a member of the emergency services, such as a fireman, and they are required to climb or clamber over a window ledge, the teeth of the shin guard are provided to enable the user to more easily grip onto the edge of the window ledge by moving their shin against the ledge and shifting their weight onto their leg. The weight of the user is thus applied as a downwards force onto the foot strap. This force is applied via the connection between the foot strap and shin portion of the guard to the teeth. The force thus causes the engagement surface of the teeth in communication with the ledge to at least partially engage the ledge. The combination of connected teeth with the ledge and the arrangement of the engagement surfaces of the teeth provide enough restrictive movement of the guard relative to the ledge to enable the user to move over the ledge. In addition, the entire surface of the shin guard, and other portions of the equipment that may come into contact with the surface being scaled, protect the user's legs from being injured by the window ledge and any protruding shards of broken glass.

For different object surfaces, the teeth and their associated engagement surfaces may operate in slightly different ways. For example, if the surface or object is made of a non-penetrable material, such as a hard metal, the teeth will not locate within the material of the object, but will provide a lever mechanism or clamping mechanism to move a user over the object using the leg as the pivotal point.

If any of the teeth are subsequently broken or damaged due to use, the user may easily repair the equipment by replacing the associated tooth. This may be done by easily detaching the broken tooth, column of teeth or teeth arrangement, and replacing it with a new one.

The equipment may be worn either, at least partially, over the top of existing clothing or footwear, or alternatively, at least partially, underneath existing, clothing or footwear.

The above described equipment thus provides a light, durable and hard wearing piece of protective equipment in the form of a climbing aid that can be worn comfortably for long periods of time by users. The equipment enables users to more easily and quickly move over and through objects without causing injury to themselves and without being excessively impeded.

For example, in the military, soldiers are expected to spend a lot of time on one knee and as such the kneed pad may be required for such a purpose. In the modern arena soldiers are expected to climb in and out of windows with broken glass, or over all, fences and vehicles. Although soldiers are trained to use suitable climbing techniques, in certain threatening circumstances, the soldier may choose to use a more basic approach to scaling the obstacle. The equipment described herein is suited for such a purpose.

Second Embodiment

Referring to FIGS. 6A to 6D a further embodiment of the invention is described.

Figures 6A, 6B, 6C:
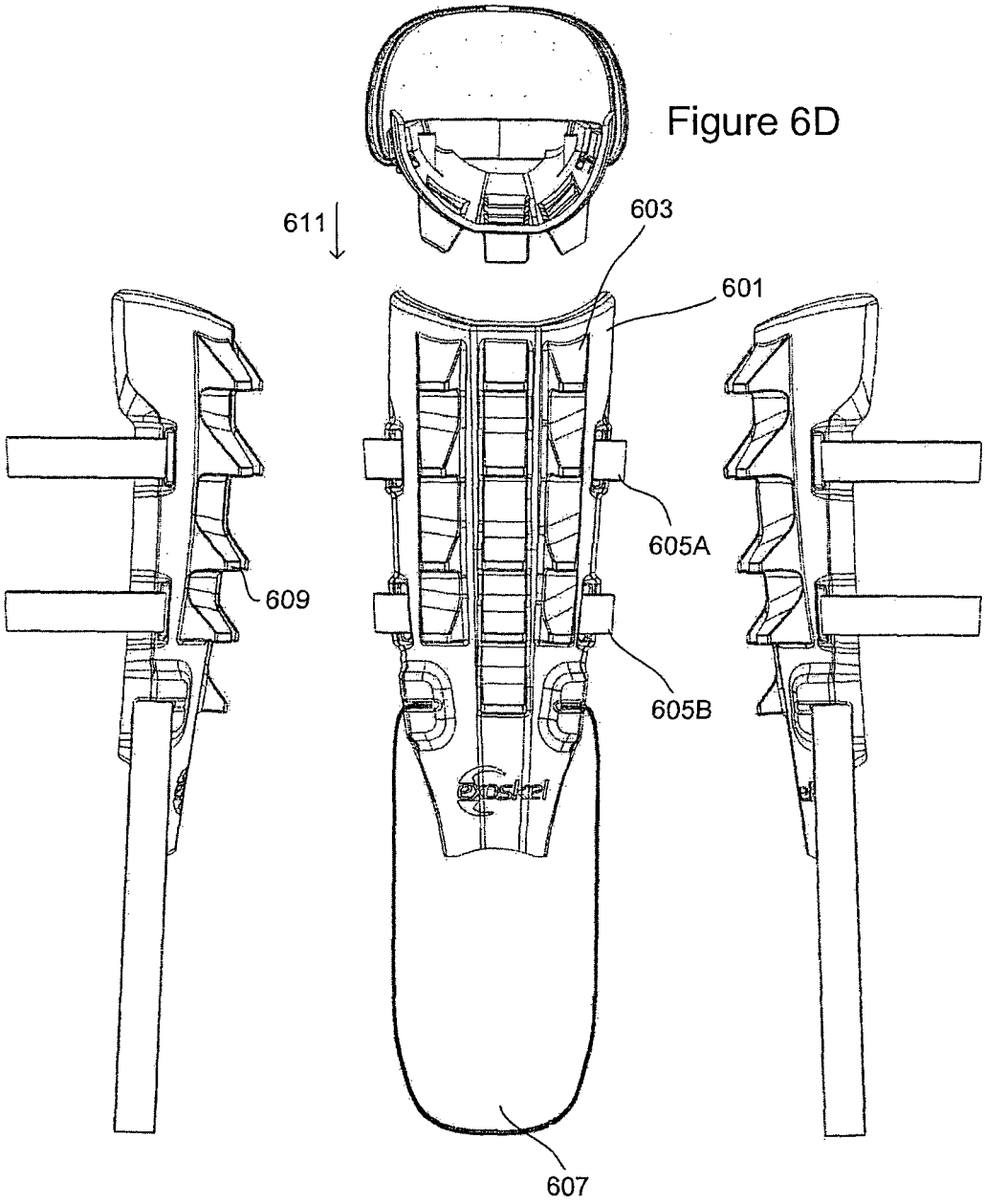

FIGS. 6A-6D show protective equipment in the form of a climbing aid from different perspectives. FIG. 6A shows the climbing aid from a front perspective view, FIGS. 6B and 6C show the climbing aid from a left and right hand perspective view and FIG. 6D shows the climbing aid from a top perspective view.

As can be seen in FIG. 6A, the climbing aid includes a front surface 601 which is an arc shape formed so that it can comfortably fit around a user's lower leg or shin. This is a similar arrangement to that as described above in the first embodiment.

Further, the climbing aid includes a plurality of teeth 603 that protrude from the front surface. The teeth may be attached permanently or semi permanently as in the first embodiment. According to this arrangement, there are three teeth in a top row, second row, third row and fourth row, with a single central tooth located centrally in a fifth bottom row.

The teeth in the top four rows are aligned in vertical columns. The teeth in each column have substantially the same profile. That is, the teeth in the left hand side column all have substantially the same profile, which is of an opposite profile to that of the teeth in the right hand column. The profiles of the teeth in the left and right hand columns are slightly offset. Further, the teeth in the second row are slightly bigger than the teeth in the other rows.

Two leg straps 605A and 605B are attached to the front surface of the climbing aid to enable the aid to be attached to a user's lower leg in a similar manner as the leg strap of the first embodiment.

Further, a foot strap 607 acting as a support element is provided for use in a similar mariner as described in the first embodiment.

According to this embodiment, the climbing device does not include a knee guard. Further, the arrangement of the teeth is different to that of the first embodiment.

As can be seen in FIG. 6B in particular, each tooth is formed with a substantially flat lower surface 609. Further, a larger gap is provided between the second and third row of teeth to provide assistance with gripping larger objects when in use.

Further, all the teeth in this embodiment are arranged so that they protrude outwards from the front surface of the equipment in substantially the same direction, as can be seen from FIG. 6D as indicated by the arrow 611. That is, the side edges (and in particular the outer side edges) of the teeth protrude forwards from the front surface in substantially the same direction. It will be understood that this form of arrangement enables the item to be produce on a machining tool with minimal cost.

As in the first embodiment, the teeth are formed from a rigid material which in this embodiment is a polycarbonate plastic. As an alternative, the teeth may be formed from any other suitable material, such as metal or a composite material.

As an alternative, the teeth may be arranged to protrude at other angles where alternative methods of manufacture are used, such as casting or moulding for example.

For example, where it is considered that the central column of teeth is positioned at a fixed position on a clock face at 12 o'clock, the outside (vertical) columns of teeth may be positions at a position substantially equal to 10 and 2 o'clock. In other words, where the front surface forms an arc, the neighboring columns of teeth protrude at angles of approximately +/−30 degrees from the central column position.

It will be understood that, as one or more further alternatives, the angle may be varied by anywhere between +/−1 and 10 degrees.

It will be understood that, as an alternative, this embodiment may include a knee pad as described above in the first embodiment.

Further Embodiments

It will be understood that the embodiments of the present invention described herein are by way of example only, and that various changes and modifications may be made without departing from the scope of invention.

It will be understood that various elements of different embodiments of the invention may be produced as a part of, or incorporated within, standard protective clothing issued to various personnel. For example, the teeth portions may be woven into the protective clothing, where a portion of the protective clothing itself forms the guard to provide a protective layer over the user's limbs. For example, the teeth may be attached or applied to the front surface of a pair of protective trousers, or manufactured as part of a pair of protective trousers, where the trousers also have incorporated therein, or attachable thereto, a support strap at its lower portion to enable a user to insert their foot. In this example, the trousers form the guard to provide a protective layer by way of the clothing material and provide a climbing aid via the teeth. The teeth attached to the clothing, in conjunction with the support strap for the limb, enable a user to climb over obstacles in a similar manner as that described herein.

Alternatively, the protective clothing could have teeth protruding through the protective clothing whereby the teeth are fastened using any suitable means to the inside of the clothing, such as the trouser leg for example. Further, it will also be understood that the support strap (the stirrup, for example) may be attached to or incorporated as part of the clothing.

Further, it will be understood that the support strap may have an adjustment device to adjust its positioning and fitting.

As an alternative to the pivotal connecting elements of the climbing aid described above, the shin guard may be connected to the knee guard by way of a flexible membrane that is attached between the shin guard and the knee guard around the periphery of the guard surfaces. The flexible membrane may be attached to the shin guard and knee guard by any suitable affixing means, whether permanent, semi-permanent or detachable. The membrane will thus provide flexible movement in all directions.

The equipment described herein may also include a cover portion that is in connection with a lower portion of the device. This cover portion protrudes outwards from the equipment so that it lies over the top of a user's foot, thus protecting the top portion of the user's foot, when the equipment is worn. The cover portion may be fixed in place with an attachment means between the cover portion and equipment. The attachment means may allow a minimal degree of movement, or may be more freely attached, such as pivotally or via a more flexible membrane, to allow the user to have unimpeded movement.

It will be understood that the teeth may be integrally formed as part of the front surface of the climbing aid, formed on a separate plate that is then able to be attached to and detached from the front surface, formed on multiple plates for attachment to and de-attachment from the front surface, or formed as individual teeth that can be individually attached to and detached from the front surface.

Figure 3:
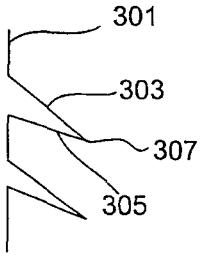
FIG. 3 shows an alternative tooth profile arrangement according to an embodiment of the present invention.
Figure 4:
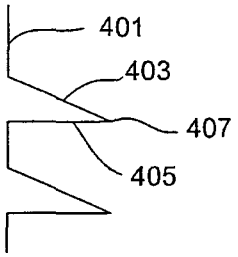
FIG. 4 shows a further alternative tooth profile arrangement according to an embodiment of the present invention.
Figure 5:
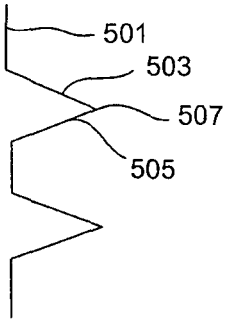
FIG. 5 shows a further alternative tooth profile arrangement according to an embodiment of the present invention.

FIGS. 3, 4 and 5 show alternative teeth profile configurations that may be used in conjunction with the climbing aid. It will be understood that the climbing aid is not required to use teeth that are all shaped in an identical manner.

FIG. 3 shows an alternative profile for a tooth that may be used with the above described invention. The tooth is attached to a front surface 301 of the climbing aid, or alternatively, to a plate that is subsequently attached to the climbing aid. The tooth profile includes an upper surface 303 protruding in a direction generally downwards towards the lower portion of the climbing aid and away from the front surface 301. It also includes a lower surface 305 that protrudes in a direction also generally downwards and towards the lower portion of the climbing aid and away from the front surface 301. The ends of the upper 303 and lower 305 surfaces meet together to form the engagement surface 307.

FIG. 4 shows a further alternative profile for a tooth that may be used with the above described invention. The tooth is attached to a front surface 401 of the climbing aid, or alternatively, to a plate that is subsequently attached to the climbing aid. The tooth profile includes an upper surface 403 protruding in a direction generally downwards towards the lower portion of the climbing aid and away from the front surface 401. It also includes a lower surface 405 that protrudes substantially perpendicular to and away from the front surface 403. The ends of the upper 403 and lower 405 surfaces meet together to form the engagement surface 407.

FIG. 5 shows a further alternative profile for a tooth that may be used with the above described invention. The tooth is attached to a front surface 501 of the climbing aid, or alternatively, to a plate that is subsequently attached to the climbing aid. The tooth profile includes an upper surface 503 protruding in a direction generally downwards towards the lower portion of the climbing aid and away from the front surface of the climbing aid. It also includes a lower surface 505 protruding in a direction generally upwards towards the upper portion of the climbing aid and away from the front surface of the climbing aid. The ends of the upper 503 and lower 505 surfaces meet together to form the engagement surface 507.

In the described embodiment, the climbing aid is specifically formed on a shin guard, with further optional protective elements. It will be understood that the inventive concept may also be applied to equipment that could be used to protect other limbs or extremities, such as the arms. That is, a similar arrangement may be applied to a guard that fits over the user's forearm, with support straps arranged to fit around the upper arm just past the elbow. In this manner, the teeth may protrude outwards from the forearm to assist the user in scrambling over objects.

The invention claimed is:

1. A climbing aid for attachment to the limbs, the climbing aid comprising:

a front guard, comprising a front surface with a plurality of teeth protruding from the front surface, the plurality of teeth being configured to assist a user in climbing over an obstacle; and a weight bearing support attached to the front guard, the weight bearing support being configured to bear a weight of a user, wherein the teeth include at least one engagement surface arranged to at least partially engage with a surface of the obstacle when pressure is applied to the weight bearing support.

2. The climbing aid of claim 1, wherein one or more teeth include a plurality of engagement surfaces.

3. The climbing aid of claim 1, wherein the engagement surface is formed as a longitudinal edge.

4. The climbing aid of claim 1, wherein the engagement surface is formed as a point.

5. The climbing aid of claim 1, wherein the teeth include at least one engagement surface arranged to at least partially penetrate the obstacle surface when the at least one engagement surface is at least partially engaged with the surface of the obstacle.

6. The climbing aid of claim 1, wherein the teeth include at least one engagement surface arranged to at least partially attach to the obstacle surface when the at least one engagement surface is at least partially engaged with the surface of the obstacle.

7. The climbing aid of claim 1, wherein the teeth include at least one engagement surface arranged to lock onto the obstacle surface through the application of downward pressure when worn by the user.

8. The climbing aid of claim 1, wherein the teeth include at least one engagement surface arranged to frictionally attach, grip or clamp onto the obstacle surface when the at least one engagement surface is at least partially engaged with the surface of the obstacle.

9. The climbing aid of claim 1, wherein the teeth include or are comprised of one or more spikes.

10. The climbing aid of claim 1, wherein the teeth are formed having an upper surface and a lower surface, wherein the engagement surface is formed where the upper and lower surface meet.

11. The climbing aid of claim 1, wherein the teeth include a hook portion.

12. The climbing aid of claim 1, wherein the front guard includes an upper portion positioned near a user's knee when worn by the user and a lower portion positioned near a user's foot when worn by the user.

13. The climbing aid of claim 12, wherein the teeth include an upper surface protruding in a direction generally downwards towards the lower portion and away from the front surface, and a lower surface protruding initially generally upwards towards the upper portion and then generally downwards towards the lower portion in an arc away from the front surface, wherein the distal ends of the upper and lower surfaces meet together at the engagement surface.

14. The climbing aid of claim 12, wherein the teeth include an upper surface protruding in a direction generally downwards towards the lower portion and away from the front surface, and a lower surface protruding in a direction generally downwards and towards the lower portion and away from the front surface, wherein the distal ends of the upper and lower surfaces meet together at the engagement surface.

15. The climbing aid of claim 12, wherein the teeth include an upper surface protruding in a direction generally downwards towards the lower portion and away from the front surface, and a lower surface protruding substantially perpendicular to and away from the front surface, wherein the distal ends of the upper and lower surfaces meet together at the engagement surface.

16. The climbing aid of claim 12, wherein the teeth include an upper surface protruding in a direction generally downwards towards the lower portion and away from the front surface, and a lower surface protruding in a direction generally upwards towards the upper portion and away from the front surface, wherein the distal ends of the upper and lower surfaces meet together at the engagement surface.

17. The climbing aid of claim 12 wherein the weight bearing support is a foot strap connected to the lower portion of the front guard.

18. The climbing aid of claim 17, wherein the foot strap is a stirrup.

19. The climbing aid of claim 12 further including a knee guard in connection with the upper portion of the front guard.

20. The climbing aid of claim 19 further including a flexible attachment portion for connecting the knee guard to the front guard.

21. The climbing aid of claim 20, wherein the flexible attachment portion includes a hinge.

22. The climbing aid of claim 19 further including a flexible loop of material attached to the knee guard for flexibly attaching the knee guard to a user's leg when worn by the user.

23. The climbing aid of claim 12 further including a pivotal cover portion protruding from the lower portion.

24. The climbing aid of claim 1, wherein the teeth are integrally formed with the front surface of the front guard.

25. The climbing aid of claim 1, wherein the teeth are detachable from the front surface of the front guard.

26. The climbing aid of claim 1 further including one or more columns of teeth.

27. The climbing aid of claim 26 further including three adjacent columns of teeth.

28. The climbing aid of claim 27, wherein the three columns are positioned substantially equidistant from each other.

29. The climbing aid of claim 1, wherein the teeth are formed from a rigid material.

30. The climbing aid of claim 1, wherein the teeth are formed from one of the group consisting of: metal; rubber; composite material.

31. The climbing aid of claim 1, wherein the front surface is formed generally in an arc shape.

32. The climbing aid of claim 1 further including one or more attachment elements for attachment around a user's leg when worn by the user.

33. The climbing aid of claim 1 arranged to be at least partially worn on the inside of a user's existing footwear.

34. The climbing aid of claim 1 arranged to be at least partially worn over the outside of a user's existing footwear.

35. The climbing aid of claim 20 further including a thigh guard in pivotal connection with an upper portion of the knee guard.

36. The climbing aid of claim 35, further including a flexible loop of material attached to the thigh guard for flexibly attaching the thigh guard to a user's leg when worn by the user.

37. The climbing aid of claim 1, wherein the front guard forms a front part of a leg on a pair of trousers.

38. The climbing aid of claim 1, wherein the front guard is a shin guard.

39. The climbing aid of claim 1, wherein the front guard is an arm guard.

40. The climbing aid of claim 1, wherein the weight bearing support is positioned so that a part of the user is beneath the teeth when the user wears the climbing aid.

41. The climbing aid of claim 40, wherein the teeth project away from the front surface of the front guard in a forward facing direction, the forward facing direction being a direction a user faces when wearing the climbing aid.

42. The climbing aid of claim 1, wherein the teeth are configured to engage the obstacle and constrain movement of the climbing aid relative to the obstacle when the teeth are engaged with the obstacle.

43. The climbing aid of claim 42, wherein the teeth are configured to bear a weight of the climbing aid and the weight of the user when the teeth are engaged with the obstacle.

44. The climbing aid of claim 1, wherein the weight bearing support is suspended from the front guard.

* * * * *